United States Patent [19]

Wiethaup et al.

[11] Patent Number: 4,602,647

[45] Date of Patent: Jul. 29, 1986

[54] VENTILATING TIP FOR A SMOKABLE ARTICLE

[75] Inventors: Wolfgang Wiethaup, Hamburg; Werner Schneider, Quickborn; Kurt Paulsen, Hamburg, all of Fed. Rep. of Germany

[73] Assignee: B.A.T. Cigaretten-Fabriken GmbH, Fed. Rep. of Germany

[21] Appl. No.: 688,395

[22] Filed: Jan. 2, 1985

[30] Foreign Application Priority Data

Jan. 2, 1984 [DE] Fed. Rep. of Germany ..... 3400004

[51] Int. Cl.[4] ..... A24D 3/18; A24D 3/04

[52] U.S. Cl. ..... 131/336; 131/340; 131/361

[58] Field of Search ..... 131/336, 339–341, 131/361, 198.1

[56] References Cited

U.S. PATENT DOCUMENTS

| | | | |
|---|---|---|---|
| 2,833,289 | 5/1958 | Atkins | 131/198.1 |
| 3,490,461 | 1/1970 | Osmalov et al. | 131/336 |
| 3,646,941 | 3/1972 | Doppelt | 131/336 |
| 3,648,711 | 3/1972 | Berger et al. | 131/340 |
| 4,517,996 | 5/1985 | Vester | 131/336 |

*Primary Examiner*—Vincent Millin
*Assistant Examiner*—H. Macey
*Attorney, Agent, or Firm*—Armstrong, Nikaido, Marmelstein & Kubovcik

[57] ABSTRACT

A tip for a smokable article comprises a tubularly arranged covering material with an air-pervious ventilation zone, and also a tubular core which is within the covering material and which contains no filter material. The air-impervious tube wall of this core has a tubular outlet region directed towards the smoker and also a conically tapering inlet region provided with a small inlet aperture and directed towards the tobacco. Between the core and the covering material, through-flow ducts are formed by appropriate shaping of the surface of the core and these in conjunction with the remaining shape of the core define the draw resistance of this tip, and at the same time dilute the smoke through the air aspirated through the ventilation zone.

This core can be manufactured from an extruded tubular blank of synthetic plastic material, in which the ducts are formed sectionwise by means of eccentrics.

10 Claims, 4 Drawing Figures

VENTILATING TIP FOR A SMOKABLE ARTICLE

BACKGROUND OF THE INVENTION

1. Field of the Invention

The invention relates to a mouthpiece or tip for a smokable article. Such tips are used more particularly for the smoking of cigarettes and can, like a conventional filter tip, be arranged directly on the tobacco rod of the cigarette or constructed as a separate tip into which the cigarette can be inserted.

2. Description of the Prior Art

Such tips are known in many forms as filter tips, in other words they contain a filter material ad/absorbing by a physical/chemical method solid particles contained in the tobacco smoke. This filter material may also be used in conjunction with throughflow ducts which block in the course of time so that a corresponding modification of the draw resistance occurs adapted to the smoking operation (German OS No. 32 25 073). These flow ducts can be constructed as longitudinal grooves in the outer surface of a core which is filled with the filter material (German OS No. 32 16 667 and German OS No. 33 12 706).

It is also known to combine the filtering action of such filter materials with a ventilation effect, wherein the smoke is diluted by pure air drawn in from the outside (German OS No. 32 46 898, German OS No. 33 11 903). In such cases the desired draw resistance is achieved when smoking by a bunch of coarse fibres or by a lamellar, film or sheet material corrugated in the longitudinal direction and/or at least partly of fibrous construction (German OS No. 33 11 903) or by a thin-drawn stick of bonded substantially non-crimped filaments (German OS No. 32 46 898).

A tip for a cigarette is also known which comprises an element in the form of a small stick of closed-cell cellulose acetate with an incorporated capillary tube with open ends made of a synthetic plastic material. A plurality of grooves serving as throughflow ducts are distributed uniformly over the circumference of this stick-shaped element and extend from the ventilation zone of the covering paper to the outlet end of the tip (German OS No. 31 16 052).

A disadvantage in the known forms of embodiment is the use of a filter material or at least a stick-shaped element made of closed-cell cellulose acetate, since the production cost of such a tip is thereby greatly increased.

Finally from U.S. Pat. No. 2,833,289 a tip is known, which comprises a covering zone in the covering paper, and a tubular core made for example of a synthetic plastic material and comprising at its inlet side, directed towards the tobacco skein, a small inlet aperture and at its outlet side directed towards the smoker an outlet aperture.

This core consists of a simple cylindrical synthetic plastic material tube provided at the inlet side with a shielding plate provided with a small aperture. Apertures are also provided in the wall of this synthetic plastic material tube which are in alignment with the ventilation apertures in the covering paper, so that the pure air sucked in from the outside through the apertures in the covering paper and in the tubular wall of the synthetic plastic material tube mixes with the smoke drawn in from the skein of tobacco in the said tube and thus dilutes such smoke, in other words the concentration of the smoke reaching the smoker is substantially lower.

However, the simple construction of such a "ventilation element" has to be at the expense of the disadvantage that the draw resistance of the cigarette, especially in the case of high degrees of ventilation, is not in the desired range to which the smoker is accustomed. Also it is only possible to manufacture this tip non-continuously, so that its production costs are relatively high.

SUMMARY OF THE INVENTION

Therefore, the invention has as its object to provide a tip for a smokable article of the specified category wherein the above-mentioned disadvantages do not occur.

More particularly it is intended to provide a tip of very simple construction comprising only a single synthetic plastic material part and the usual covering paper or other covering material, and whose draw resistance can be adapted with no problem to the desired values.

Therefore the invention proposes in a tip for a smokable article with a covering material arranged in tubular form, with an air-pervious ventilation zone in the covering material, and with a tubular core, which has a small inlet aperture at its inlet side directed towards the skein of tobacco and an outlet aperture at its outlet side directed towards the smoker, the improvement in which the air-impervious envelope of the hollow core comprises an outlet region which is tubular and which is directed towards the smoker, and a conically narrowing inlet region provided with the inlet aperture and directed towards the tobacco rod and that continuous hollow throughflow ducts extending from the small inlet aperture to the outlet aperture are formed in the outer surface of the core.

Advantageous forms of embodiment are brought together in the subordinate claims.

The advantages achieved with the invention are due in the first instance to the simple production of such a "ventilation element", which can be made from an extruded synthetic plastic material tube, for example having a base of polypropylene or polyethylene. The throughflow ducts are formed sectionwise by eccentrics which press-in appropriately the outer surface of this synthetic plastic material tube. In the inlet region the throughflow ducts are depressed so far that the remaining inner diameter of the tube corresponds to the desired size of inlet aperture. Should the inlet apertures become closed in this production operation due to fluctuations in production tolerances, the inlet aperture can be held open by means of a stationary insertion mandrel.

This one-piece, tubular synthetic plastic material part can be surrounded if necessary with the conventional porous/perforated wrapping paper and also finally with the covering paper provided with the usual ventilation zone achieved by perforations or inherent porosity.

This covering paper or tipping material at the same time can also be used for attaching this tip to the tobacco skein of a smokable article more particularly a cigarette.

The configuration of this synthetic plastic material core as indicated provides a plurality of separate flow paths, namely a central flow path for the smoke through the inlet aperture through the interior of the hollow core to the outlet aperture on the one hand, and through the throughflow ducts between the outer surface of the core and the covering material on the other hand; in these outer throughflow ducts the smoke drawn in from the skein of tobacco mixes with the pure air sucked in through the ventilation zone, with the result that the tobacco smoke is greatly diluted. This diluted tobacco mixes again in the smoker's mouth with the smoke from the central path of flow, and the particular draw resistance in each case can be adjusted by adjusting the appropriate construction parameters of this tip.

Variables include the degree of filter ventilation, the size of the inlet aperture, the draw resistance of the throughflow ducts between the ventilation zone and the mouth end of the tip, these, with a given cross-section for the throughflow ducts, corresponding to the length thereof, and also the constructional solution for the ventilation zone; since a strip-shaped ventilation zone of this kind can be formed either by the inherent porosity of the covering paper which contains microscopic holes or by perforations, i.e. by microscopic or macroscopic holes which are produced by electrostatic discharges, by laser beams, or by a mechanical method. Whilst the microscopic holes have a diameter of approximately 0.05 mm, the macroscopic perforations are generally of the order of magnitude of 0.2 mm.

The parameters indicated above can be varied in the new tip, so that it is possible to cover a wide range of draw resistance values for the complete cigarette, or the varying of the draw resistance with the draw volume.

BRIEF DESCRIPTION OF THE DRAWINGS

The invention is described in more detail hereinafter with the help of an example of embodiment with reference to the accompanying diagrammatic drawings. In these drawings

DESCRIPTION OF THE PREFERRED EMBODIMENT

Figure 1:
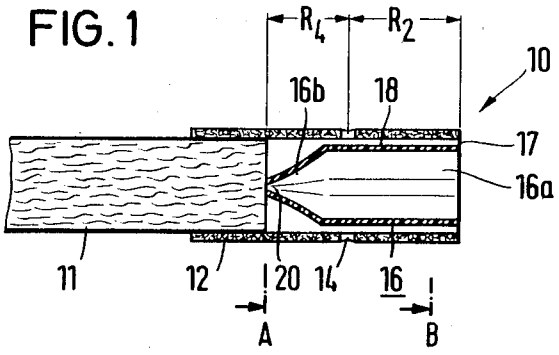
FIG. 1 shows a longitudinal section through the basic construction of such a tip.

FIG. 1 shows a tip which is given the general reference numeral 10 and which is connected securely to the tobacco rod 11 of a cigarette. This tip comprises a core 16 of polypropylene or polyethylene which will be described further and which is connected to the tobacco skein 11 by a conventional tubularly arranged covering material, more particularly covering paper or tipping material 12.

This tubular-arrangement covering paper 12 includes a stripform circumferential ventilation zone 14 which can be formed either by macroscopic perforations or microscopic apertures in the covering paper 12 in this region.

Arranged in the interior of the tubular covering paper 12 is the core 16 which is made of synthetic plastic material and which comprises a tubular outlet region **16*a* which is directed towards the smoker and a conically narrowing inlet region 16*b* directed towards the tobacco 11**.

Figure 3:
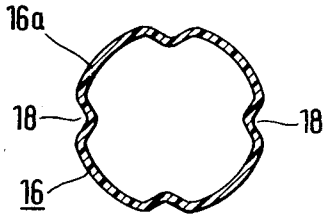
FIG. 3 shows a section along the line B in FIG. 1
Figure 2:
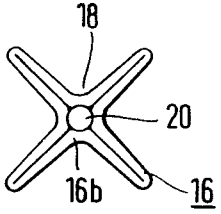
FIG. 2 shows a section along the line A in FIG. 1.

As FIGS. 2 and 3 illustrate, such a core 16 can be produced from a tubular extruded blank of synthetic plastic material in whose outer surface throughflow ducts 18 of varying depth are pressed locally by eccentrics. In the outlet region **16*a* these flow ducts 18 are of only relatively slight depth, in other words approximately in the form of shallow grooves, whereas in the inlet region 16*b* the impressed depth increases continuously, and at the left-hand end of the core 16 as considered in FIG. 1 the tubular blank is compressed to such an extent that the remaining tube inner diameter reaches the desired size for the inlet aperture 20 (see FIG. 2**).

In the illustrated form of embodiment a total of four throughflow ducts 18 are formed in the core 16, producing four vaneform projections in the inlet region **16*b* between the corresponding recesses (see FIG. 2**).

Since the core 16 is covered externally by the covering paper or tipping material 12 the throughflow ducts are defined on the one hand by the inner surface of the covering paper 12 and on the other hand by the recesses 18 in the outer surface of the core 16.

In a tip 10 for a cigarette the length of the tip 10 is usually in the range between 20 and 30 mm; the tip 10 has a diameter of 7.95 mm in adaptation to the usual diameter of a cigarette.

As regards the length of the core 16, namely on the one hand the region between the ventilation zone 14 and the tobacco end of the core, at which the inlet aperture 20 is situated, and on the other hand the region between the ventilation zone 14 and the mouth-side end of the core, in which the outlet aperture 17 of the tip 10 is situated.

The corresponding lengths are indicated in FIG. 1 by the associated draw resistances of the portions of the throughflow ducts 18, namely the draw resistance R4 between the tobacco end of the core 16 and the ventilation zone 14, and, respectively, the draw resistance R2 between the ventilation zone 14 and the mouth end of the core 16. The actual values of the draw resistances R2, R4 depend on the spacial dimensions of the throughflow ducts also.

The length of the region R4 should amount to at least 5 mm, whereas the length of region R2 should be in the region of 8 mm. (insertion depth established in accordance with German DIN Standard on smoking).

By way of a variation on the illustrated form of embodiment the tip 10 can be provided with 3 to 8 ducts, and the total cross-section of all the throughflow ducts should be in the region of 1 to 4 $mm^2$, and the individual cross-sections of the throughflow ducts should be in the range of 0.2 $mm^2$ to 0.8 $mm^2$.

The dimensioning of the throughflow ducts should be made such that the draw resistance, measured over all the throughflow ducts, is between 30 and 200 mm water column.

The inlet aperture 20 at the tapering end of the core 16 should have an area of 0.2 to 0.5 $mm^2$, more particularly 0.3 to 0.4 $mm^2$.

A plurality of separate flow paths are provided in this tip, namely on the one hand the central flow path through the inlet aperture 20 and the interior of the core 16 to the outlet aperture, and on the other hand flow paths through the outer throughflow ducts between the outer surface of the core 16 and the inner surface of the covering paper 12. In these outer flow paths air is also aspirated from the outside via the ventilation zone 14 of the covering paper 12, and dilutes the smoke coming from the tobacco. This diluted smoke flows together with the pure smoke into the mouth of the smoker, and the various proportions can be adapted to the particular conditions required in each case by appropriate choice of the parameters determining the flows, namely the cross-sections of the outer throughflow ducts, the diameter of the inlet aperture, the length of the tip, and the position and type of ventilation zone 14.

Figure 4:
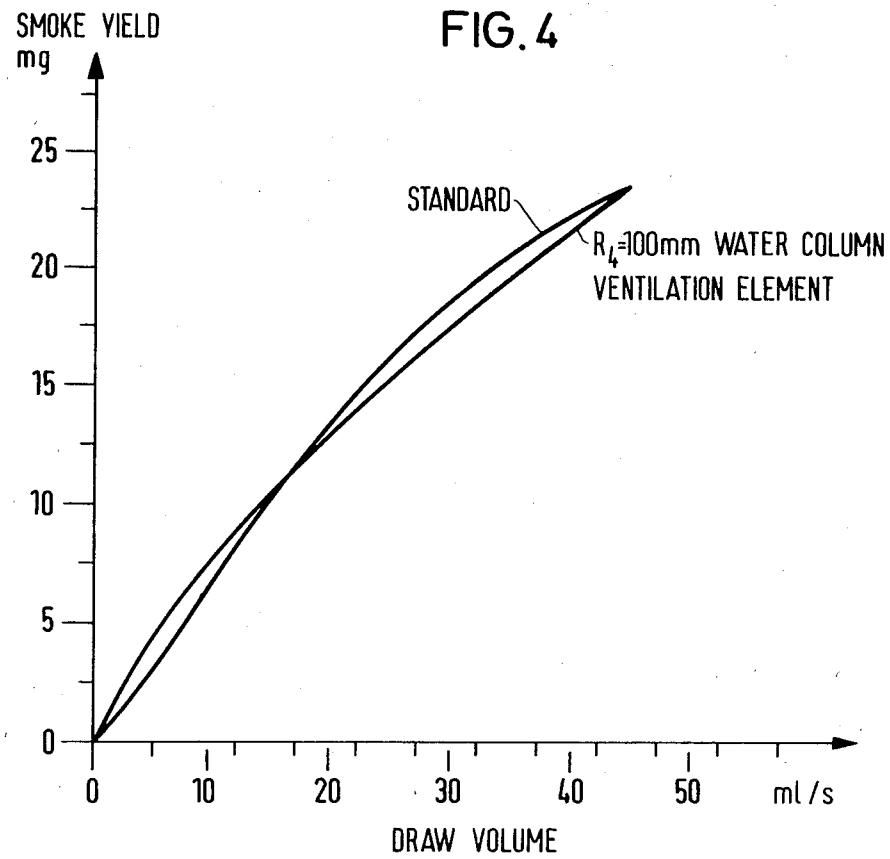
FIG. 4 shows a representation of the smoke yield of a standard filter and a form of embodiment of a tip according to the invention respectively, as a function of the draw volume.

FIG. 4 shows with the use of curves the smoke yield in mg, in other words the yield of nicotine-free dry condensate plotted over the draw volume in ml/s for a tip with a standard acetate filter on the one hand and a tip according to the invention on the other hand, wherein the flow resistance or the pressure drop R4 for the regions of the throughflow ducts between the ventilation zone 14 and the tobacco end amounted to 100 mm water column. The ventilation zone was formed by microporous regions in the covering paper 12, and the individual pores had a diameter of approximately 0.05 mm. With the same tobacco skein in each case and with a draw volume of 17.5 ml/s, the cigarette with the standard acetate filter had a filter ventilation degree of 25%, a total draw resistance of 90 mm water column and a quotient of CO/nicotine-free dry condensate of 1. With the ventilation element according to the invention the corresponding values are 60%, 120 mm water column and a CO/nicotine-free dry condensate ratio of 0.6.

It will be apparent that with the tip according to the invention it is possible to achieve almost the same smoke yield as with a standard acetate filter even without using filter material. In the case of small draw volumes the smoke yield for the tip according to the invention is above the smoke yield for the standard acetate filter, whereas in the case of relatively large draw volumes the smoke yield with the tip according to the present invention drops below that of the standard acetate filter. Certainly the CO/condensate ratio shifts from 1 with conventional standard filters to 0.6 when using the ventilation elements according to the present invention.

A draw resistance R4=0 means that the ventilation zone 14 is situated precisely at the transition in the throughflow ducts 18 from the conical inlet region **16*b* to the tubular outlet region 16*a*. The higher the numerical value for R4 is, for example expressed in 20 mm or 100 mm water column, the more is the ventilation zone 14 shifted from this transition point in the direction towards the mouth end of the tip 10. Thus in actual practice the draw resistance R4 is defined by the position of the ventilation zone 14**.

By varying the various parameters, more especially the draw resistance R4, the degree of ventilation as defined by the type of and amount of ventilation, the cross-section of the throughflow ducts and the cross-section of the inlet aperture 20, greatly varying draw resistances can be achieved such as was not possible on the same scale with conventional filters. This is achieved with substantially the same smoke yield, as FIG. 4 shows.

The following Table lists draw resistance ranges of cigarettes in the case of a draw volume of 17.5 ml/s, achievable with various degrees of ventilation $V_F$ of the tip, appropriately adapting the construction parameters of this tip, namely more particularly the form of the core 16.

$V_F$=40%:60 mm water column≲draw resistance≲140 mm water column $V_F$=60%:45 mm water column≲draw resistance≲120 mm water column $V_F$=80%:35 mm water column≲draw resistance≲110 mm water column This must be seen in comparison with a draw resistance of 25 to 35 mm water column such as occurs with commercially obtainable 80% filter ventilated cigarettes with throughflow ducts.

When using the ventilation element according to the present invention a cigarette smoked in accordance with DIN specifications yields a condensate quantity which, with constant tobacco rod data, is determined only by the degree of ventilation. The draw resistance is freely selectable over a considerable range (see above Table) for a specific condensate quantity, with the aid of the above-mentioned construction parameters.

In contrast thereto, with standard filter arrangements a desired condensate quantity is achieved by ventilation and filtration. With a specific degree of ventilation, in that case the draw resistance is no longer freely selectable, since varying the filter material as would be necessary for varying the draw resistance would also change the filtration.

We claim:

1. In a smokable article having a tobacco rod and a cylindrical tipping material to connect a tip thereto, which comprises:

(a) an air impervious hollow core having a conically tapering inlet region terminating in a small inlet aperture adjacent said tobacco rod, an outlet region terminating in a circular outlet directed towards the smoker, and a plurality of circumferentially spaced grooves in the outer surface of said hollow core extending from the inlet to the outlet; and (b) said grooves and said tipping material forming throughflow ducts along said core.

2. Tip according to claim 1, in which the core is provided with three to eight grooves which are formed by pressing-in the appropriate surface regions of a tubular blank.

3. Tip according to claim 2, in which said grooves are pressed-in so far in the conically narrowing inlet region that the remaining inner diameter of the tube corresponds to the desired diameter of the inlet aperture.

4. Tip according to claim 3, in which the throughflow ducts in the outlet region are in the form of shallow depressions, which are in throughflow communication with a ventilation zone.

5. Tip according to claim 1 in which the tipping material has a ventilation zone extending in strip form in the circumferential direction, and the transition between the inlet region and the outlet region is situated approximately at the location of the ventilation zone.

6. Tip according claim 1, in which the tubular outlet region has a length of at least 8 mm and the conically narrowing inlet region has a length of approximately 5 mm.

7. Tip according claim 1 in which the throughflow ducts have a total cross-section of approximately 1 to 4 $mm^2$.

8. Tip according to claim 7 in which the throughflow ducts are so dimensioned that the draw resistance measured over all the throughflow ducts amounts to between 30 and 200 mm water column.

9. Tip according to claim 1 in which the inlet aperture has an area of 0.2 to 0.5 $mm^2$, more particularly 0.3 to 0.4 $mm^2$.

10. Tip according claim 1 in which the core consists of polypropylene or polyethylene.

* * * * *

UNITED STATES PATENT AND TRADEMARK OFFICE

CERTIFICATE OF CORRECTION

PATENT NO. : 4,602,647

DATED : July 29, 1986

INVENTOR(S) : WOLFGANG WIETHAUP ET AL

It is certified that error appears in the above-identified patent and that said Letters Patent is hereby corrected as shown below:

On the cover page, Item [73], change "Japan" to

--- Alsterufer, Hamburg, Germany ---.

Signed and Sealed this

Eleventh Day of August, 1987

*Attest:*

DONALD J. QUIGG

*Attesting Officer*

*Commissioner of Patents and Trademarks*